US008079681B2

(12) United States Patent
Yokouchi

(10) Patent No.: US 8,079,681 B2
(45) Date of Patent: Dec. 20, 2011

(54) FLUID CONTAINER HOLDER AND FLUID EJECTING APPARATUS

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 525 days.

(21) Appl. No.: 12/354,474

(22) Filed: Jan. 15, 2009

(65) Prior Publication Data

US 2009/0179973 A1 Jul. 16, 2009

(30) Foreign Application Priority Data

Jan. 15, 2008 (JP) ..... 2008-005951

(51) Int. Cl.
*B41J 2/175* (2006.01)

(52) U.S. Cl. ..... 347/85

(58) Field of Classification Search ..... 347/85
See application file for complete search history.

(56) References Cited

FOREIGN PATENT DOCUMENTS

| | | |
|---|---|---|
| JP | 11-309869 | 11/1999 |
| JP | 2003-200590 | 7/2003 |
| JP | 2006-248048 | 9/2006 |
| JP | 2007-137072 | 6/2007 |

*Primary Examiner* — Matthew Luu
*Assistant Examiner* — Lisa Solomon
(74) *Attorney, Agent, or Firm* — Workman Nydegger

(57) ABSTRACT

A fluid container holder has an attachment position to which a fluid container can be attached and detached with movement of the fluid container. The fluid container has a cantilevered fluid supply member bringing a holder flow hole into contact with a container flow hole to enable the fluid to flow when the fluid container is attached to the attachment position. The fluid supply member has a free end that can be elastically deformed about a fixed end where the holder flow hole is disposed. A fluid flow channel connecting the holder flow hole to a fluid source is disposed from the free end to the fixed end. The free end is elastically deformed about the fixed end when the fluid container moves to apply a pressing force to the free end in a state where the container flow hole is in contact with the holder flow hole.

9 Claims, 9 Drawing Sheets

FLUID CONTAINER HOLDER AND FLUID EJECTING APPARATUS

BACKGROUND

The entire disclosure of Japanese Patent Application No. 2008-005951, filed Jan. 15, 2008, are expressly incorporated herein by reference.

1. Technical Field

The present invention relates to a fluid container holder to and from which a fluid container such as an ink cartridge can be attached and detached and a fluid ejecting apparatus such as an ink jet printing apparatus having the fluid container holder.

2. Related Art

In the past, ink jet printing apparatuses (hereinafter, referred to as "printer") as a fluid ejecting apparatus ejecting a fluid from a fluid ejecting head to a target were widely known. Among such printers, a printer supplying ink from an ink cartridge (fluid container) containing ink (fluid) to a print head (fluid ejecting head) is provided with a cartridge holder (fluid container holder) which the ink cartridge can be attached to and detached from (for example, see JP-A-2007-137072).

That is, in the cartridge holder described in JP-A-2007-137072, an ink supply needle (fluid supply member) capable of being inserted into and pulled out of an ink supply hole (fluid supply hole) of the ink cartridge and an air introduction member (operating fluid supply member) capable of coming in close contact with a pressurized air introduction hole (container flow hole) of the ink cartridge are disposed parallel to each other in a drawing-out direction of the ink cartridge. By allowing the ink cartridge to move in an attachment direction, the ink supply needle is inserted into the ink supply hole and an end of the air introduction member comes in close contact with the pressurized air introduction hole, whereby the ink cartridge is attached to a predetermined attachment position. By allowing the ink cartridge to move from the attachment position in the drawing-out direction, the ink supply needle is taken out of the ink supply hole and the end of the air introduction member is separated from the pressurized air introduction hole, whereby the ink cartridge is detached from the cartridge holder.

However, in the final step of attaching the ink cartridge to the cartridge holder and in the first step of detaching the ink cartridge from the cartridge holder, a pressing force is applied to the end of the air introduction member in the cartridge holder from the ink cartridge moving in the attachment direction. Accordingly, in the cartridge holder of the printer described in JP-A-2007-137072, the end portion of the air introduction member includes a cylindrical supporting tube, a cylindrical sliding member slidably disposed on the supporting tube, and a coil spring always urging the sliding member to the end of the air introduction member.

In the final step of attaching the ink cartridge to the cartridge holder and in the first step of detaching the ink cartridge from the cartridge holder, when the pressing force from the ink cartridge is applied, the sliding member backwardly move against the urging force of the coil spring with the pressing force applied from the ink cartridge. By urging the backwardly-moved sliding member to an end of the air introduction member with the urging force of the coil spring, an end opening of the sliding member which is the end of the air introduction member is brought into close contact with the pressurized air introduction hole of the ink cartridge.

However, in the above-mentioned configuration of the air introduction member in the cartridge holder, since it is necessary to assemble plural members (supporting tube, sliding member, and coil spring), the assembly efficiency of the cartridge holder deteriorates. In addition, since the number of members increases, it is difficult to reduce the manufacturing cost.

SUMMARY

An advantage of some aspects of the invention is that it provides a fluid container holder of which the number of components can be reduced to improve the assembly efficiency and to reduce the manufacturing cost and a fluid ejecting apparatus having the fluid container holder.

According to an aspect of the invention, there is provided a fluid container holder having an attachment position to and from which a fluid container containing a fluid can be attached and detached with movement of the fluid container in a predetermined direction and comprising an operating fluid supply member bringing a holder flow hole into a close contact with a container flow hole of an operating fluid disposed in the fluid container when the fluid container is attached to the attachment position. Here, the operating fluid supply member has a cantilever shape of which a free end can be elastically deformed about a fixed end thereof, the holder flow hole is disposed at the free end, an operating fluid flow channel connecting the holder flow hole to an operating fluid source is disposed from the free end to the fixed end, and the free end is elastically deformed about the fixed end when the fluid container moves to apply a pressing force to the free end in a state where the container flow hole is brought into contact with the holder flow hole at the time of attachment to and detachment from the attachment position.

According to this configuration, the operating fluid supply member is completely assembled into the fluid container holder by fixing the fixed end thereof. When the fluid container moves to apply the pressing force to the free end in the state where the container flow hole is in contact with the holder flow hole disposed at the free end at the time of attaching or detaching the fluid container, the free end is elastically deformed about the fixed end. A restoring force of the elastically-deformed free end serves as an urging force bringing the holder flow hole of the operating fluid supply member into close contact with the container flow hole of the fluid container. Accordingly, it is not necessary to additionally assemble a sliding member or an urging member independent of the operating fluid supply member. Therefore, it is possible to reduce the number of components, thereby improving the assembly efficiency and reducing the manufacturing cost.

In the fluid container holder, the operating fluid supply member may be configured to pressurize the inside of the fluid container by pressurizing and supplying the operating fluid into the fluid container in a state where the holder flow hole is brought into close contact with the container flow hole of the fluid container or to make the inside of the fluid container a negative pressure state by sucking the operating fluid from the inside the fluid container.

According to this configuration, when the operating fluid is pressurized and supplied into the fluid container through the operating fluid supply member, the fluid contained in the fluid container can be drawn out in a pressurized state with the pressurizing force. When the operating fluid is sucked from the fluid container through the operating fluid supply member, the inside of the fluid container can be made to be a negative-pressure state with the sucking force.

In the fluid container holder, a groove portion extending from the fixed end to the free end may be formed on one surface of the operating fluid supply member, a film forming the operating fluid flow channel may be bonded to the surface to cover the groove portion, and the holder flow hole may be disposed on the other surface at the free end of the operating fluid supply member to communicate with the groove portion.

According to this configuration, an operating fluid flowing tube formed of a silicon tube or the like need not be drawn to form the operating fluid flow channel. Accordingly, since leakage of the fluid from the silicon tube or the like can be suppressed and a drawing space can be omitted, it is possible to properly cope with the requirement for a decrease in size.

In the fluid container holder, a cylindrical portion extending in a detachment direction from the attachment position of the fluid container may be provided to the free end of the operating fluid supply member, an opening of an end of the cylindrical portion may constitute the holder flow hole, and a guide portion slidably guiding the cylindrical portion in the axis direction thereof when the free end of the operating fluid supply member is elastically deformed may be provided in the vicinity of the operating fluid supply member.

According to this configuration, even when the free end of the operating fluid supply member is elastically deformed with the pressing force from the fluid container, the cylindrical portion of which the opening at the end constitutes the holder flow hole is slidably guided in the axis direction by the guide portion. Accordingly, it is possible to excellently maintain the close contact between the container flow hole of the fluid container and the holder flow hole of the operating fluid supply member.

In the fluid container holder, the operating fluid flow member may be formed by cutting a plate-like elastic flow channel forming member in the form of an elastically-deformable cantilever shape.

According to this configuration, when the flow channel forming member from which the operating fluid supply member is cut is fixed to the fluid container holder, the fluid container holder can be assembled more easily than when the fixed end of the operating fluid supply member having a cantilever shape is fixed directly to the fluid container holder.

In the fluid container holder, the flow channel forming member may be provided with a fluid supply member that can be inserted into or taken out of a fluid supply hole disposed independently of the container flow hole, so as to extend in the detachment direction from the attachment position of the fluid container and may be provided with a fluid flow channel allowing the fluid, which is supplied from the fluid container through the fluid supply hole and the fluid supply member, to flow to the downstream where the fluid is consumed so as to avoid the cut portion of the operating fluid supply member.

According to this configuration, by assembling the flow channel forming member, a flow channel of the fluid contained in the fluid container and a flow channel of the operating fluid flowing to and from the fluid container to draw out the fluid from the fluid container well can be constructed rapidly and easily.

The fluid container holder may further include a lock mechanism which can be locked to the fluid container so as to regulate the movement of the fluid container in the detachment direction in the state where the container flow hole is brought into close contact with the holder flow hole of the operating fluid supply member at the attachment position.

According to this configuration, the movement of the fluid container located at the attachment position in the detachment direction is regulated by the locking of the locking mechanism. Accordingly, at the attachment position, the state where the holder flow hole of the operating fluid supply member is in close contact with the container flow hole can be maintained excellently.

In the fluid container holder, the operating fluid may be air.

According to this configuration, since the operating fluid is air, it is possible to further improve the flow response property of the operating fluid (air in this case) between the fluid container and the operating fluid supply member by the difference in viscosity than when the operating fluid is liquid such as silicon oil. The flowing air is lighter than the liquid. Accordingly, when the operating fluid supply path is formed of a tube, the weight of the tube is reduced.

According to another aspect of the invention, there is provided a fluid ejecting apparatus including a fluid ejecting head ejecting a fluid and the above-mentioned fluid container holder.

According to the above-mentioned configuration, it is possible to obtain the same advantages as the fluid container holder.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
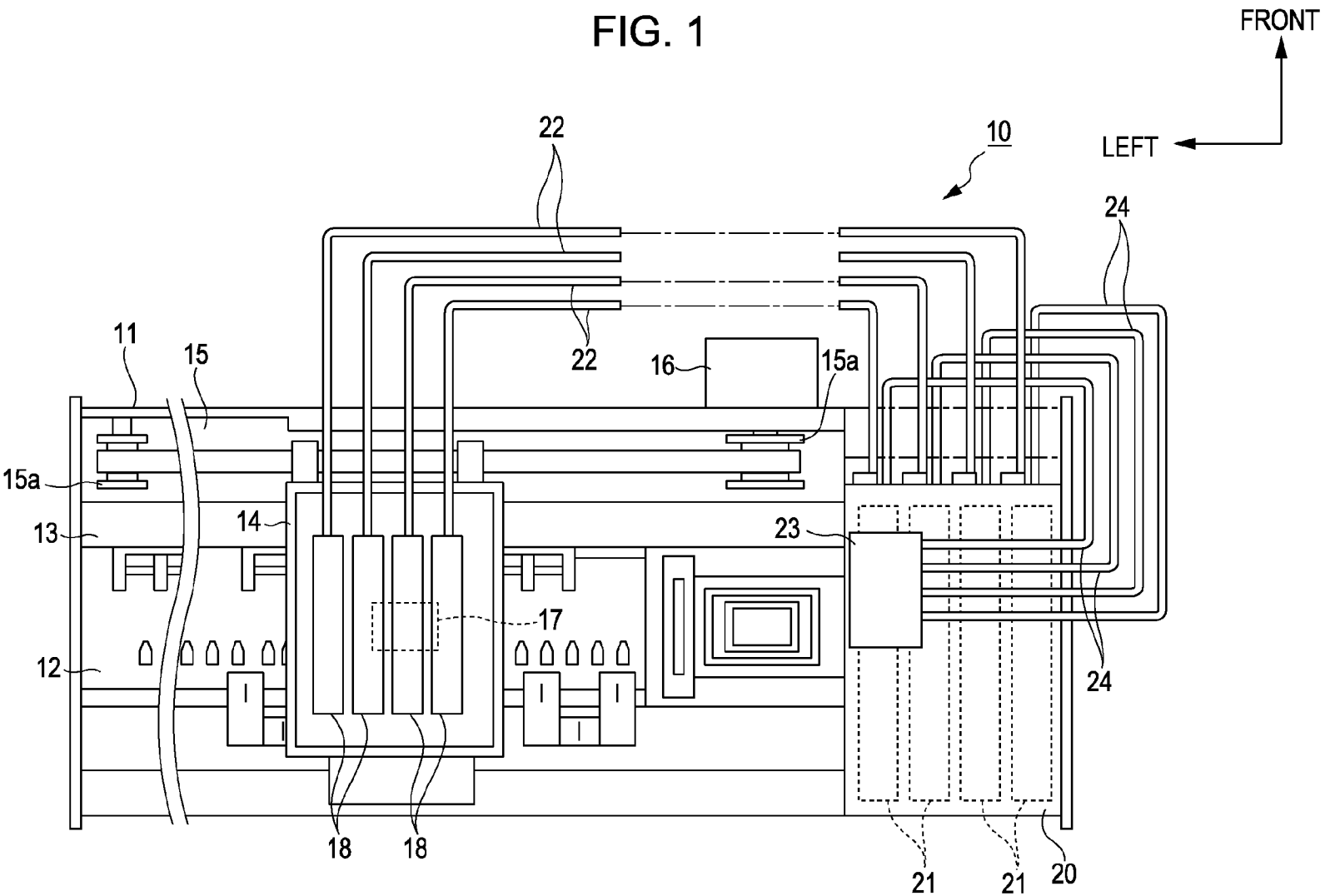
FIG. 1 is a plan view illustrating an ink jet printer according to an embodiment of the invention.

Hereinafter, an embodiment in which the invention is embodied in an ink jet printer (hereinafter, referred to as "printer") as a kind of liquid ejecting apparatus and a cartridge holder of the printer will be described with reference to FIGS. 1 to 10. In the below description, a "front-rear direction", an "up-down direction", and a "left-right direction" are as indicated by arrows in the drawings.

As shown in FIG. 1, a platen 12 is disposed in a frame 11 of a printer 10. A recording sheet as a target not shown is fed onto the platen 12 by a sheet feeding mechanism having a sheet feeding motor not shown. A rod-like guide member 13 is disposed in the frame 11 to be parallel to the longitudinal direction of the platen 12.

A carriage 14 is supported by the guide member 13 so as to reciprocate in the axis direction of the guide member 13. The carriage 14 is connected to a carriage motor 16 through a timing belt 15 suspended between a pair of pulleys 15*a* disposed in the frame 11. The carriage 14 reciprocates along the guide member 13 with the actuation of the carriage motor 16.

A surface of the carriage 14 opposed to the platen 12 is mounted with a print head 17 as a fluid ejecting head consuming ink (fluid) by ejecting the ink to the recording sheet. The carriage 14 is provided with plural (four in this embodiment) valve units 18 supplying the temporarily-stored ink to the print head 17 to correspond to the colors (kinds) of ink used in the printer 10.

An end (right end) of the frame 11 in FIG. 1 is provided with a cartridge holder 20 as the fluid container holder. Plural (four in this embodiment) ink cartridges 21 as the fluid container are detachably attached to the cartridge holder 20. Ends of plural (four in this embodiment) ink supply tubes 22 of which the other ends are connected to the valve units 18 on the carriage 14, respectively, are connected to the cartridge holder 20.

A pressurizing pump 23 as the operating fluid source is disposed above the cartridge holder 20. The pressurizing pump 23 is connected to the cartridge holder 20 through plural (four in this embodiment) air supply tubes 24. In the state where the ink cartridges 21 are attached to the cartridge holder 20, the ink cartridges 21 are connected to the ink supply tubes 22 and the air supply tubes 24, respectively.

When the pressurizing pump 23 is driven, air as the operating fluid is supplied to the ink cartridges 21 through the air supply tubes 24, the ink in the ink cartridges 21 is pressurized by the air, and the pressurized ink is supplied to the valve units 18 through the ink supply tubes 22.

The configurations of the ink cartridges 21 and the cartridge holder 20 to which the ink cartridges 21 are attached will be described in detail now with reference to FIGS. 2 and 3.

The respective ink cartridges 21 have a cartridge case 25 having a thin rectangular parallelepiped shape and a flexible ink pack (not shown) filled with a color of ink, where the colors of ink are different by the ink cartridges 21 is received in a cartridge case 25 thereof. Since the ink cartridges 21 have the same configuration except for the shape of an erroneous-attachment preventing protrusion 21*a*, one ink cartridge 21 of the plural (four in this embodiment) ink cartridges 21 will be representatively described. Regarding the cartridge holder 20, a portion to which one ink cartridge 21 is attached will be partially described.

Figure 2:
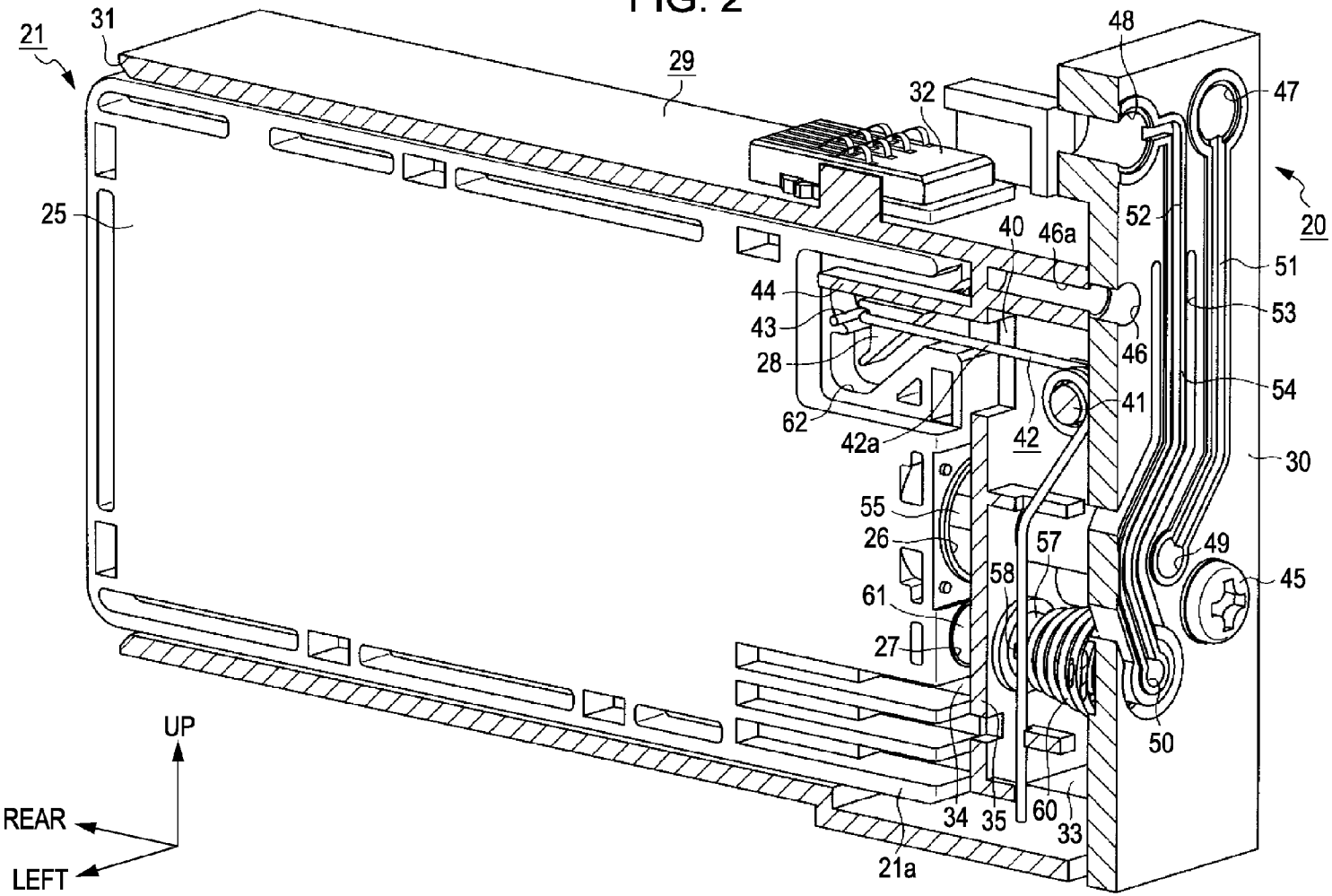
FIG. 2 is a partially-omitted perspective view of a cartridge holder according to the embodiment.

As shown in FIG. 2, at the center of the front surface of the cartridge case 25 which faces the attachment direction to the cartridge holder 20, an ink supply hole 26 as the fluid supply hole is formed to penetrate the cartridge case 25. At a position on the front surface of the cartridge case 25 below the ink supply hole 26 when the ink cartridge is attached to the cartridge holder 20, an air introduction hole 27 as the container flow hole for introducing the pressurized air through the air supply tube 24 from the pressurizing pump 23 into the ink cartridge 21 is formed.

Figure 7:
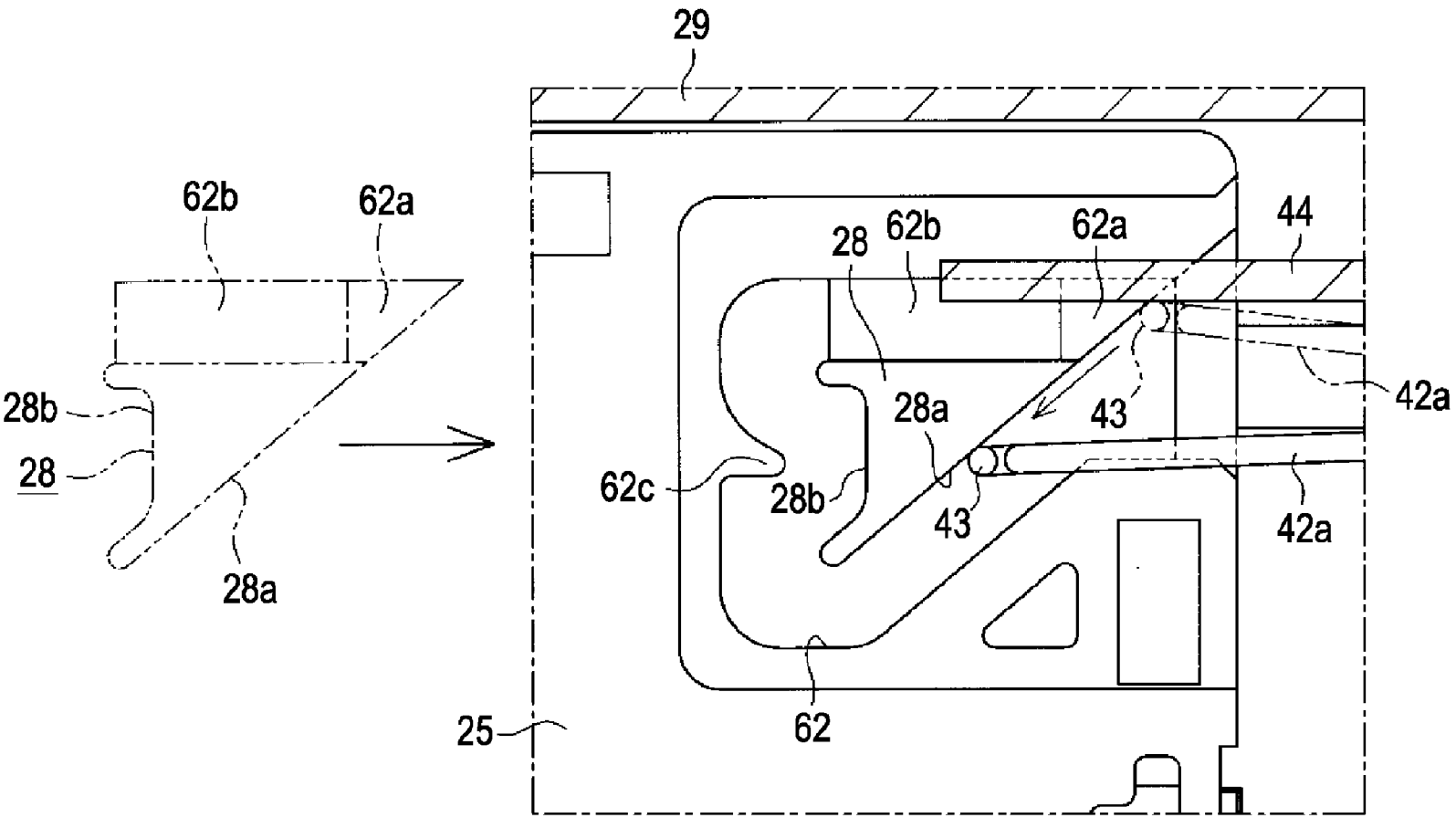
FIG. 7 is a partially-enlarged sectional view illustrating the operation of the cartridge holder at the time of starting the attachment of the ink cartridge.

An IC chip (not shown) is disposed in the front end of the top surface of the cartridge case 25. The IC chip of the ink cartridge 21 stores information on the kind (color) of ink and the amount of ink remaining in the ink cartridge 21 having the IC chip. A locking portion 28 having a substantially triangular shape in a side view as shown in FIG. 7 is projected in the front end of the side surface (left surface in this embodiment) of the cartridge case 25. The specific configuration of the locking portion 28 will be described later.

On the other hand, the cartridge holder 20 includes a holder case 29 having a quadrangular box shape of which the front and rear surfaces are opened and a plate-like flow channel forming member 30 formed out of an elastic material (such as synthetic resin) to close the opening in the front surface of the holder case 29. An insertion hole 31 allowing the ink cartridge 21 to be inserted into the holder case 29 is formed in the rear surface of the holder case 29. When the ink cartridge 21 is inserted into the holder case 29 of the cartridge holder 20, the IC chip of the ink cartridge 21 comes in contact with a terminal 32 disposed on the upper wall portion of the holder case 29, thereby inputting various information recorded in the IC chip to a controller (not shown) of the printer 10.

A partition wall 35 partitioning the inside of the holder case 29 into a mechanism receiving section 33 on the front side and a cartridge attachment section 34 on the rear side is disposed in the deep portion of the holder case 29 along the up-down direction. Positioning pins 36 and 37 (see FIG. 6) are formed to protrude from two up and down positions on the rear surface of the partition wall 35 facing the cartridge attachment section 34 to the rear side which is the detachment direction of the ink cartridge 21. When the ink cartridge 21 is attached to the attachment position (position shown in FIGS. 2 and 8) in the cartridge attachment section 34, the ink cartridge 21 is positioned by inserting the positioning pins 36 and 37 into positioning holes (not shown) formed in the front surface of the cartridge case 25 of the ink cartridge 21.

In the partition wall 35, a through hole 38 is formed at a position corresponding to the ink supply hole 26 of the ink cartridge 21 when the ink cartridge 21 is attached to the attachment position of the cartridge attachment section 34 and a guide hole 39 as the circular guide portion is formed at a position corresponding to the air introduction hole 27 in the front-rear direction. Similarly, in the partition wall 35, a rectangular window portion 40 is formed at a position corresponding to the locking portion 28 of the ink cartridge 21 in the front-rear direction when the ink cartridge 21 is attached to the attachment position of the cartridge attachment section 34.

On the other hand, in the mechanism receiving section 33 of the holder case 29, a fixed shaft 41 is disposed at a height position corresponding to the window portion 40 of the partition wall 35 and a helical spring 42 as the locking mechanism is wound on the fixed shaft 41. In the helical spring 42, a wire-like locking rod 42*a* linearly extending backward from the wound portion on the fixed shaft 41 is inserted into the window portion 40 of the partition wall 35. When the ink cartridge 21 is not attached to the cartridge attachment section 34 of the holder case 29, the clockwise rotational urging of the locking rod 42*a* about the fixed shaft 41 in FIG. 2 is regulated by bringing a locking protrusion 43, which is bent in a laterally curved shape in the end thereof, into contact with a stopper wall 44 horizontally extending backward from the vicinity of the rear upper portion of the partition wall 35.

Figure 3A:
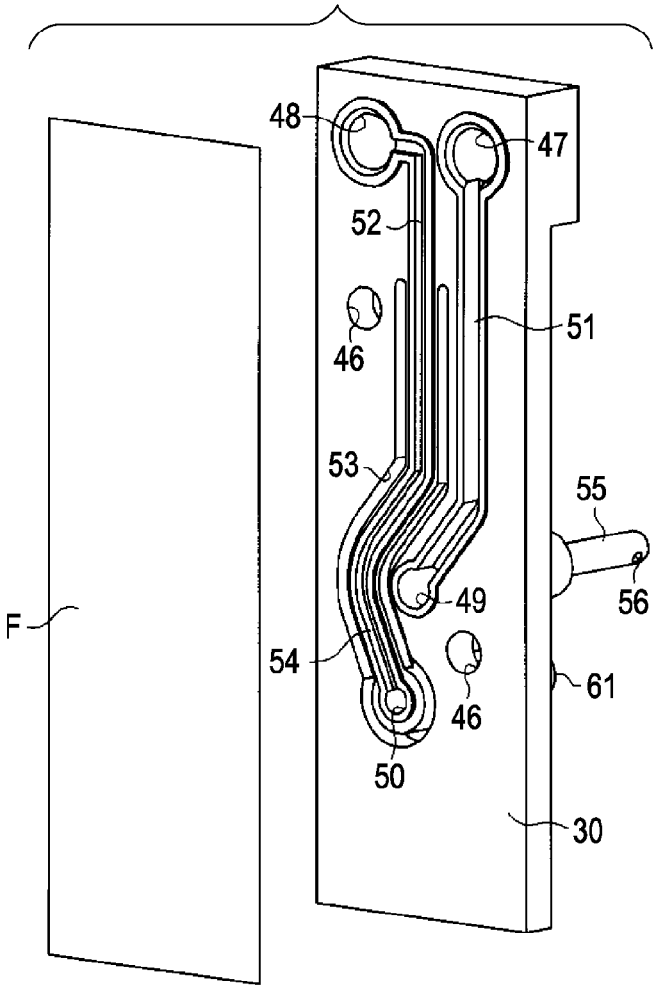
FIG. 3A is a partially-enlarged exploded perspective view of the cartridge holder and FIG. 3B is a front view of a flow channel forming member as viewed from a rear surface which is an attachment direction.

As shown in FIGS. 2 and 3A, insertion holes 46 for insertion of fixing bolts 45 are formed at two positions separated in the up-down direction and the left-right direction with the center interposed in the flow channel forming member 30. In the front surface of the holder case 29, bolt holes 46*a* having female threads (not shown) screwed to male threads of the fixing bolts 45 are formed at positions corresponding to the insertion holes 46 of the flow channel forming member 30 in the front-rear direction. By rotating the fixing bolts 45 in the state where the bolt holes 46*a* and the insertion holes 46 are positioned relative to each other to screw the male threads of the fixing bolts 45 to the female threads of the bolt holes 46*a* of the holder case 29, the flow channel forming member 30 is fixed to the holder case 29.

At two positions of the flow channel forming member 30 above the upper wall of the holder case 29 when the flow channel forming member 30 is fixed to the holder case 29, two communication holes 47 and 48 are formed in the front-rear direction. Similarly, at positions corresponding to the through hole 38 and the guide hole 39 formed in the partition wall 35 of the holder case 29 when the flow channel forming member 30 is fixed to the holder case 29, communication holes 49 and 50 are formed in the front-rear direction.

The front surface of the flow channel forming member 30 is provided with a groove portion 51 straightly extending downward in the vertical direction from the communication hole 47 and being curved to the left lower side in the vicinity of the communication hole 49 to reach the communication hole 49. Similarly, the front surface of the flow channel forming member 30 is provided with a groove portion 52 straightly extending downward in the vertical direction from the communication hole 48 and being curved in the vicinity of the communication hole 50 to reach the communication hole 50.

In portions of the flow channel forming member 30 along both edges of the groove portion 52 and the peripheral edge of the communication hole 50, a substantially U-shaped intermediate cut portion 53 along the curved shape of the groove portion 52. As a result, the cut portion along the groove portion 52 of the flow channel forming member 30 has a cantilever shape in which the upper end close to the communication hole 48 is a fixed end with respect to the flow channel forming member 30 and the lower end close to the communication hole 50 is a free end. That is, the cut portion along the groove portion 52 in the flow channel forming member 30 forms an elastic piece 54 of which the lower end is elastically deformable in the front-rear direction about the fixed end as the upper end.

A film F having a gas barrier property is bonded to the front surface of the flow channel forming member 30 having the groove portions 51 and 52 formed therein by thermal adhesion. As a result, the front openings of the groove portions 51 and 52 and the communication holes 47 to 50 communicating at the upper and lower ends of the groove portions 51 and 52 are covered with the film F, thereby forming an ink flow channel extending between the communication hole 47 and the communication hole 49 and an air flow channel extending between the communication hole 48 and the communication hole 50 in the front surface of the flow channel forming member 30. In this embodiment, a fluid flow channel is constructed by the ink flow channel including the groove portion 51 extending between the communication hole 47 and the communication hole 49 and an operating fluid flow channel is constructed by the air flow channel including the groove portion 52 extending between the communication hole 48 and the communication hole 50. The film F is cut along the intermediate cut portion 53 after the thermal adhesion, thereby not hindering the operation of the elastic piece 54.

Figure 3B:
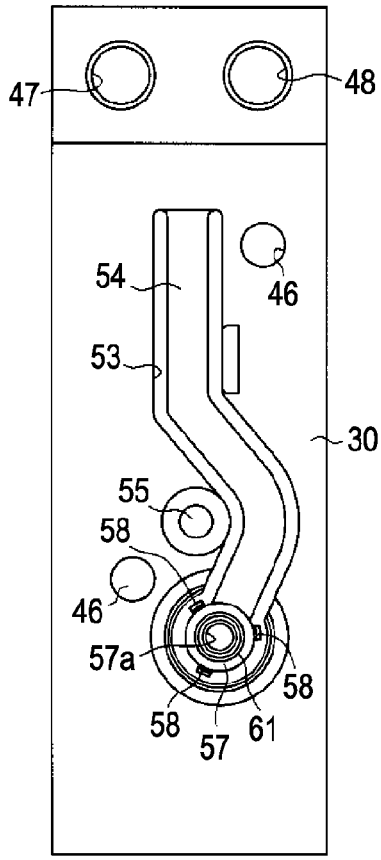

As shown in FIGS. 3A and 3B, an end of the communication hole 47 communicating with the upper end of the groove portion 51 constituting the ink flow channel is opened in the rear surface of the flow channel forming member 30 close to the holder case 29 and an upstream end of the ink supply tube 22 is connected to the rear opening of the communication hole 47. From the portion on the rear surface of the flow channel forming member 30 corresponding to the communication hole 49 communicating with the lower end of the groove portion 51 constituting the ink flow channel, an ink supply needle 55 as the fluid supply member of which the base end communicates with the communication hole 49 is formed to extend to the rear side which is directed to the insertion hole 31 of the holder case 29.

The inside of the ink supply needle 55 is hollow and an ink supply hole 56 is formed at the end thereof. The end of the ink supply needle 55 is inserted into the through hole 38 formed in the partition wall 35 of the holder case 29 and the end protrudes from the partition wall 35. When the ink cartridge 21 is inserted into the cartridge holder 20, the end of the ink supply needle 55 is inserted into the ink cartridge 21 through the ink supply hole 26 formed in the front surface of the cartridge case 25. That is, the ink in the ink cartridge 21 is guided to the print head 17 through the ink supply needle 55 and the groove portion 51 and the ink supply tube 22 forming the ink flow channel by inserting the ink supply needle 55 into the ink supply hole 26.

In the rear surface of the flow channel forming member 30, an end of the communication hole 48 communicating with the upper end of the groove portion 52 constituting the air flow channel is opened and a downstream end of the air supply tube 24 is connected to the rear opening of the communication hole 48. From the portion on the rear surface of the flow channel forming member 30 corresponding to the communication hole 50 communicating with the lower end of the groove portion 52 constituting the air flow channel, an air-introduction cylindrical portion 57 of which the base end communicates with the communication hole 50 is disposed to extend to the rear side which is directed to the insertion hole 31 of the holder case 29.

The opening 57*a* at the end of the air-introduction cylindrical portion 57 serves as the holder flow hole. The end having the opening 57*a* is inserted into the guide hole 39 formed in the partition wall 35 of the holder case 29 and is slidable in the front-rear direction perpendicular to the wall surface of the partition wall 35 by bending the elastic piece 54. At plural positions (three positions in this embodiment) on the outer peripheral surface in the air-introduction cylindrical portion 57 in front of (close to the base end) the partition wall 35, protrusions 58 protruding outward in the diameter direction are formed with a constant angular interval. A coil spring 60 is wound on the outer peripheral surface of the air-introduction cylindrical portion 57 so that it is located between the protrusions 58 and the rear surface of the flow channel forming member 30.

As a result, the air-introduction cylindrical portion 57 is restored to the original position (position shown in FIGS. 2, 3A, 3B, and 6) by the restoring force of the elastic piece 54 and the urging force of the coil spring 60, when the pressing force is applied to move to the front side which is directed to the base end. In the middle way in the axis direction of the air-introduction cylindrical portion 57, the end thereof protrudes into the cartridge attachment section 34 from the partition wall 35 and is inserted into the guide hole 39 of the partition wall 35. The air-introduction cylindrical portion 57 is designed so that the entire length in the front-rear direction is smaller than that of the ink supply needle 55.

A cylindrical seal member 61 formed of flexible material such as rubber is wound on the end of the air-introduction cylindrical portion 57 protruding from the partition wall 35. When the ink cartridge 21 is inserted into the cartridge holder 20, the air-introduction cylindrical portion 57 is brought into close contact with the air introduction hole 27 formed in the front surface of the cartridge case 25 with the seal member 61 interposed therebetween by the elastic force of the elastic piece 54 and the urging force of the coil spring 60 so as to allow the pressurized air to flow. That is, in this embodiment, the operating fluid supply member pressurizing and supplying pressurized air as the operating fluid to the inside of the ink cartridge is constructed by the elastic piece 54 having the air-introduction cylindrical portion 57 and the groove portion 52 constituting the air flow channel.

Although the flow channel forming member 30 is disposed every air flow channel corresponding to the respective colors of ink, this may be configured as follows. That is, the communication holes 50 and the groove portions 52 individually corresponding to the colors of ink are formed in a single flow channel forming member 30 and groove portions connecting the grooves portions 52 are additionally formed. Then, by bonding the film F to the flow channel forming member 30, plural air flow channels individually corresponding to the colors of ink are formed. In this configuration, since the air flow channels communicate with each other, it is possible to supply the pressurized air into the ink cartridges corresponding to the colors of ink by disposing only one air supply tube 24, thereby attaining the decrease in size of the printer 10.

Then, an operation of the cartridge holder 20 will be described with reference to FIGS. 4 to 10.

Figure 4:
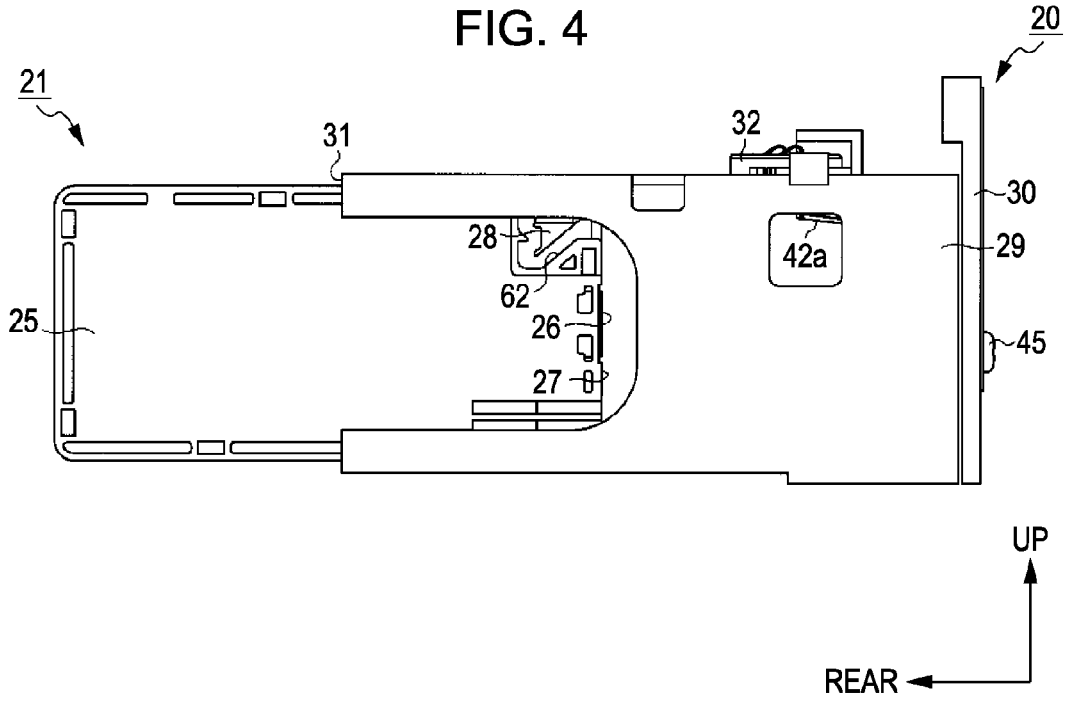
FIG. 4 is a side view illustrating the cartridge holder where an ink cartridge is being attached.
Figure 5:
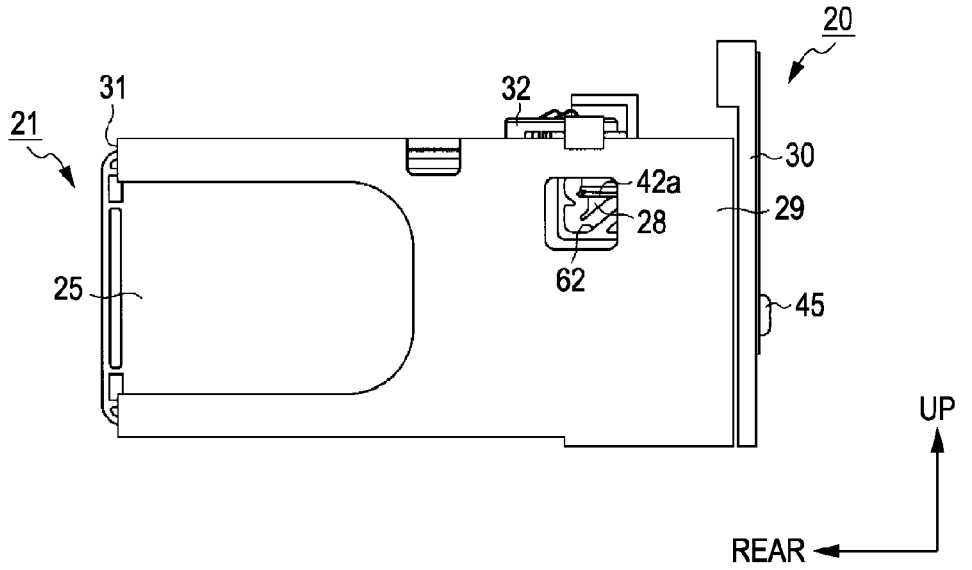
FIG. 5 is a side view illustrating the cartridge holder where the ink cartridge has been attached.

First, when the ink cartridge 21 is attached to the cartridge holder 20, as shown in FIG. 4, the ink cartridge 21 is inserted through the insertion hole 31 of the holder case 29 of the cartridge holder 20. As shown in FIG. 5, by pushing the ink cartridge 21 up to the attachment position in the cartridge attachment section 34 which is the deep section of the holder case 29, the IC chip disposed on the upper front surface of the cartridge case 25 in the ink cartridge 21 comes in contact with the terminal 32 disposed on the upper wall portion of the holder case 29, whereby the IC chip is electrically connected to the controller of the printer 10.

Figure 6:
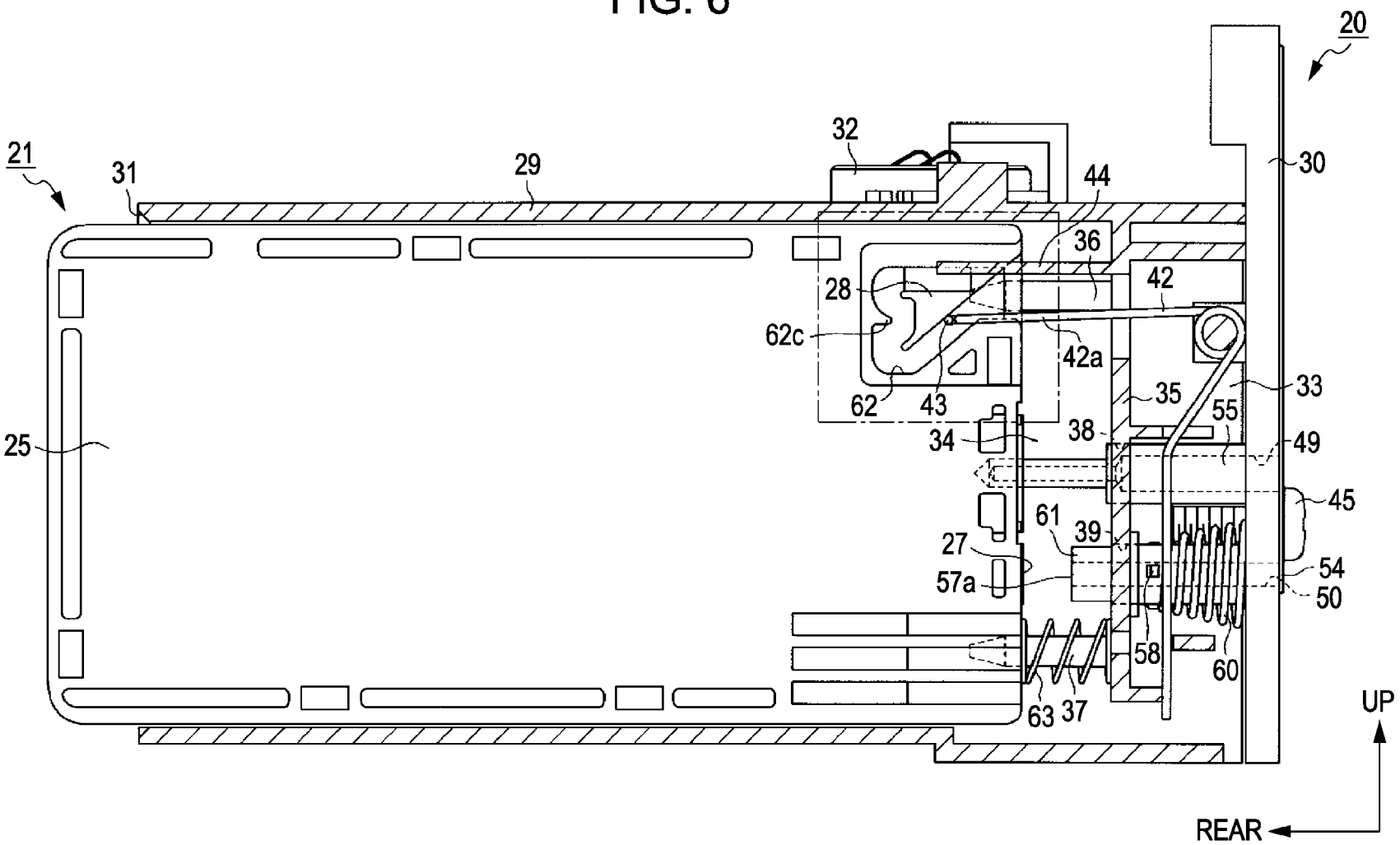
FIG. 6 is a sectional view illustrating an operation of the cartridge holder at the time of starting the attachment of the ink cartridge.

At this time, as shown in FIG. 6, when the ink cartridge 21 is inserted into the middle portion of the holder case 29, the positioning pins 36 and 37 protruding from the partition wall 35 of the holder case 29 are inserted into the positioning holes formed in the front surface of the cartridge case 25 in the ink cartridge 21, whereby the ink cartridge 21 is positioned in the vertical direction and the lateral direction in the holder case 29. At the time of attachment, by locking the locking protrusion 43 of the locking rod 42*a* in the helical spring 42 disposed in the holder case 29 to the triangular locking portion 28 formed in the front end of the left surface of the cartridge case 25 of the ink cartridge 21, the ink cartridge 21 is locked and maintained at the attachment position in a state where it is prevented from dropping.

That is, as shown in FIG. 7, the triangular locking portion 28 is formed to protrude at the front end of the left surface of the cartridge case 25 in the ink cartridge 21. The engaging groove 62 that can engage with the locking portion 43 at the end of the locking rod 42*a* in the helical spring 42 is formed around the locking portion 28 along the triangular peripheral wall of the locking portion 28.

Here, in the engaging groove 62 along the peripheral wall of the locking portion 28, the groove depth of the portion extending parallel to the stopper wall 44 in the holder case 29 is different from the groove depth of the other portion. That is, the portion extending parallel to the stopper wall 44 has a stepped portion 62*a* in which the trapezoidal portion at the front end is lower than the protrusion height of the locking portion 28 and the groove depth is smaller than that of the other portion in the engaging groove 62. The rectangular portion continuously extending backward from the stepped portion 62*a* forms a slope portion 62*b* connected to the other portion in the engaging groove 62 in a slope shape.

The guide wall surface 28*a* continuously extending in the front-rear direction in the slope shape is formed in the locking portion 28 by the front wall surface having the slope shape in the stepped portion 62*a* and the front wall surface having the slope shape in the locking portion 28. A locking concave portion 28*b* dug to the front is formed in the wall surface along the vertical direction in the rear surface of the locking portion 28 and a locking wall surface 62*c* is disposed to extend to the front side in the horizontal direction from the rear wall surface of the engaging groove 62 at a height position corresponding to the intermediate position in the vertical direction of the locking groove portion 28*b*.

Accordingly, when the ink cartridge 21 is inserted into the holder case 29, the locking protrusion 43 of the locking rod 42*a* of the helical spring 42 in a state where the locking protrusion 43 is in contact with the stopper wall 44 in the holder case 29 comes in sliding contact with the wall surface (the upper portion of the guide wall surface 28*a*) forming the front slope shape in the stepped portion 62*a* of the engaging groove 62. By slidably guiding the locking protrusion 43 downward by the use of the guide wall surface 28*a*, the locking rod 42*a* is fluctuated and bent downward about the fixed shaft 41 with a force stored therein.

Figures 8A, 8B:
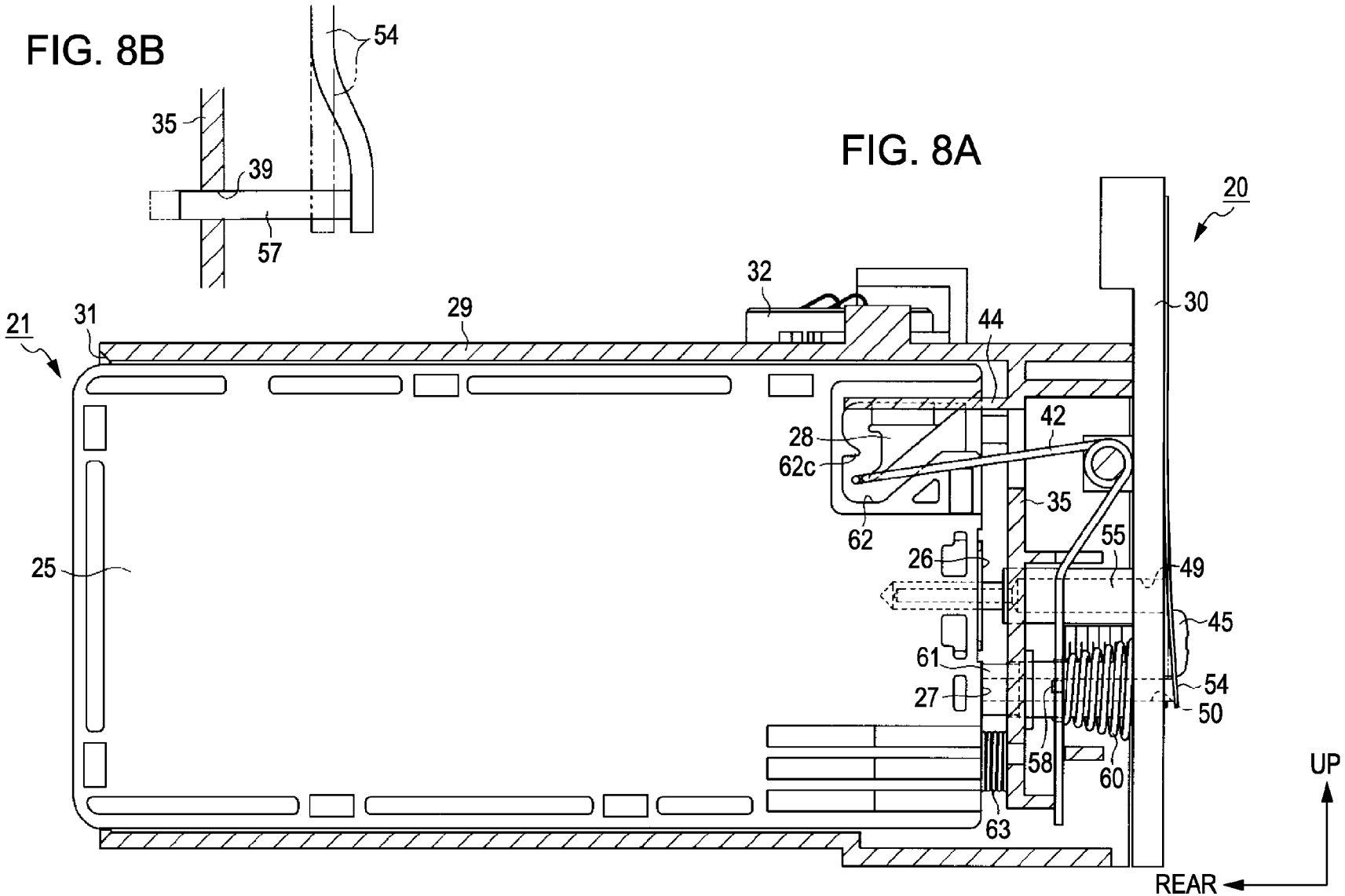
FIG. 8A is a sectional view illustrating an operation of the cartridge holder just before the attachment of the ink cartridge and FIG. 8B is a partially-enlarged sectional view of FIG. 8A.

As shown in FIG. 8A, when the ink cartridge 21 is pushed up to a position slightly exceeding the attachment position in the holder case 29 against the urging force of the coil spring 63, the locking protrusion 43 at the end of the locking rod 42*a* of the helical spring 42 reaches the rear end of the guide wall surface 28*a* of the locking portion 28. At this time, the ink cartridge 21 is pushed forward in the insertion direction in a state where the air introduction hole 27 is in close contact with the opening 57*a* of the air-introduction cylindrical portion 57 of the holder case 29.

Accordingly, the air-introduction cylindrical portion 57 of the holder case 29 is pressed forward against the urging force of the coil spring 60 and the elastic force of the elastic piece 54 by the ink cartridge 21 and is slidably guided in the horizontal direction by the guide hole 39 of the partition wall 35 to move forward. As a result, since the upper end of the elastic piece 54 having the groove portion 52 formed therein is fixedly supported by the flow channel forming member 30 to form a cantilever shape, the lower end thereof is bent about the upper end in an S shape by the distance by which it is pushed forward with the movement of the air-introduction cylindrical portion 57 (see FIG. 8B).

When the ink cartridge 21 is further pushed in the insertion direction in the above-mentioned state, the locking protrusion 43 formed at the end of the locking rod 42*a* in the helical spring 42 goes over the rear end of the guide wall surface 28*a* of the locking portion 28 of the ink cartridge 21 by the restoring force of the helical spring 42, is separated therefrom, and then comes in contact with the locking wall surface 62*c* in the engaging groove 62. When the pushing of the ink cartridge 21 is stopped, the cartridge holder 20 causes the ink cartridge 21 to move toward the insertion hole 31 by the urging force of the coil spring 60.

Figure 9:
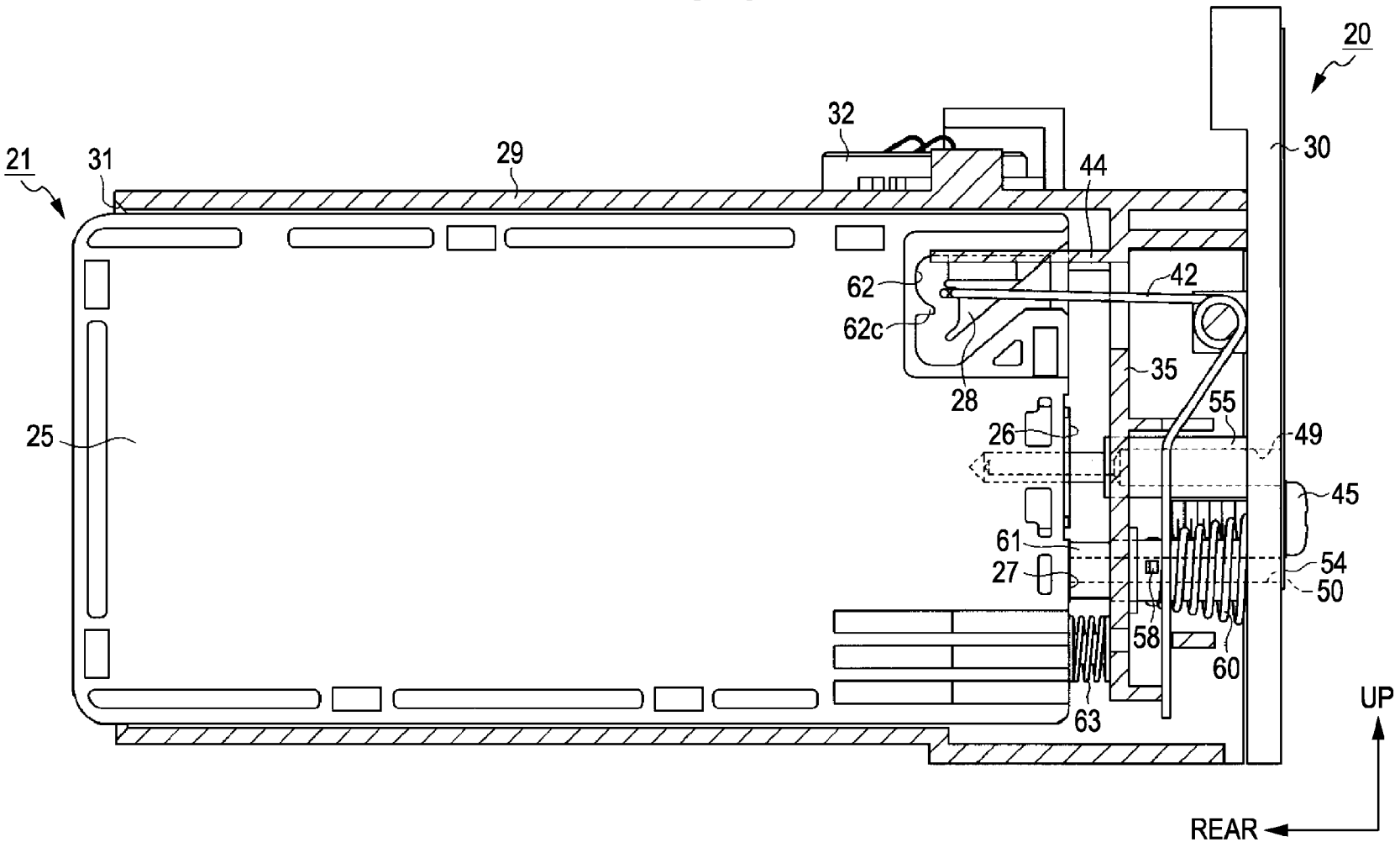
FIG. 9 is a sectional view illustrating an operation of the cartridge holder at the time of completing the attachment of the ink cartridge.
Figure 10:
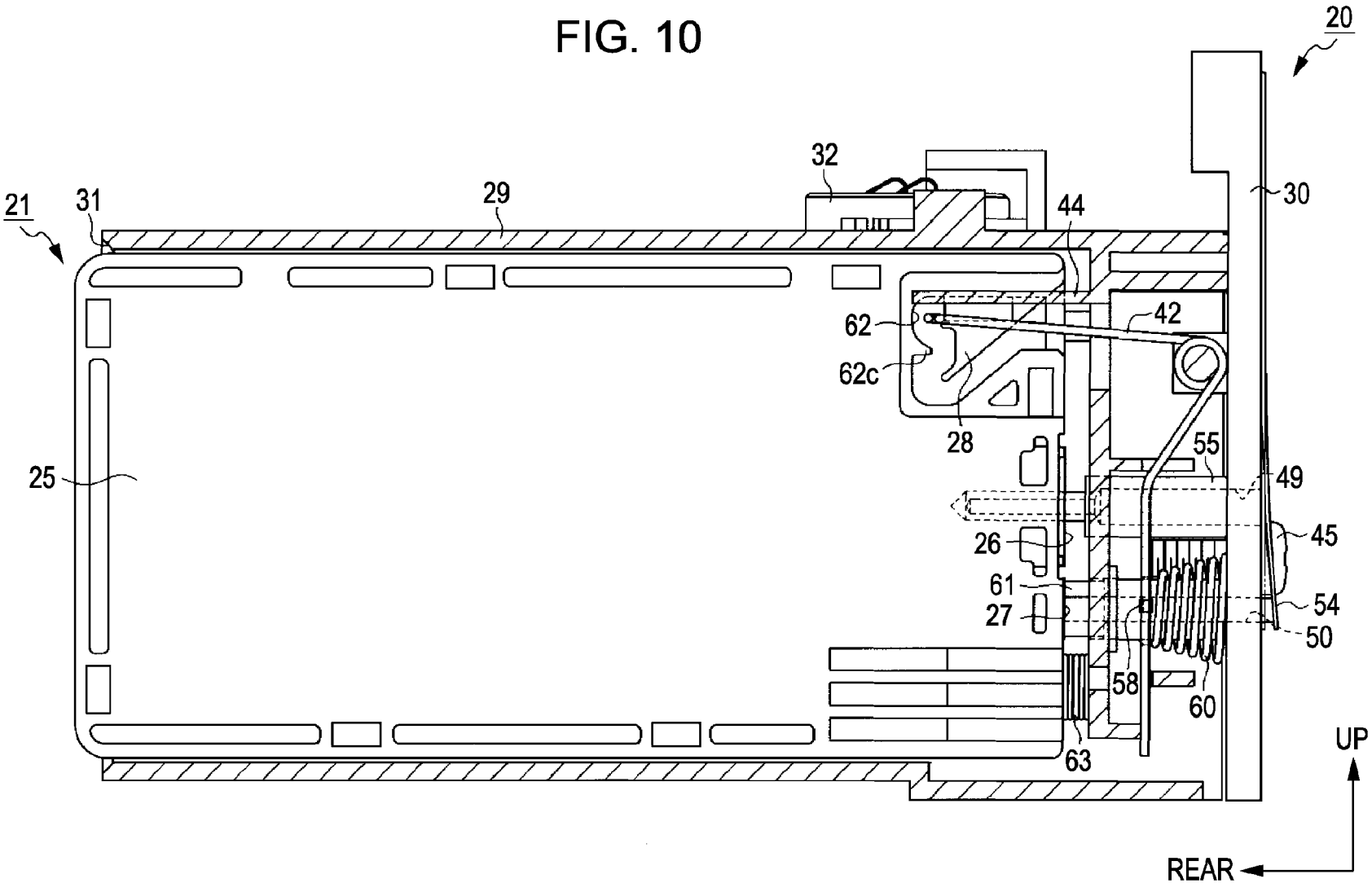
FIG. 10 is a sectional view illustrating an operation of the cartridge holder while the ink cartridge is being detached.

Accordingly, the locking protrusion 43 of the locking rod 42*a* in the helical spring 42 is separated forward from the locking wall surface 62*c* of the engaging groove 62 of the ink cartridge 21 and is then locked to the locking concave portion 28*b* of the locking portion 28 (see FIG. 9). In the elastic piece 54 having the groove portion 52 formed therein, the lower end bent with the forward pushing of the ink cartridge 21 through the air-introduction cylindrical portion 57 is restored to the before-deformation state by the restoring force of the elastic piece 54 and the urging force of the coil spring 60. The restoring force serves as the urging force for bringing the opening 57*a* (which is also the opening of the seal member 61) formed at the end of the air-introduction cylindrical portion 57 into close contact with the air introduction hole 27 of the ink cartridge 21.

When the locking protrusion 43 of the locking rod 42*a* of the helical spring 42 is locked to the locking concave portion 28*b* of the locking portion 28 of the ink cartridge 21, the ink cartridge 21 is regulated in movement toward the insertion hole 31 and is thus fixed to the attachment position. Accordingly, the ink supply needle 55 is inserted into the ink supply hole 26 of the ink cartridge 21 in a state where the opening 57*a* of the air-introduction cylindrical portion 57 is brought into close contact with the air introduction hole 27. In this state, when the pressurized air generated by the pressurizing pump 23 disposed in the frame 11 is introduced into the ink cartridge 21 through the groove portion 52 and the air-introduction cylindrical portion 57 constituting the pressurized air flow channel, the ink pack in the ink cartridge 21 is pressurized. The ink in the ink pack is pressurized and supplied to the print head 17 through the ink supply needle 55, the groove portion 51 forming the ink flow channel, and the ink supply tube 22.

On the other hand, when the ink cartridge 21 is detached from the holder case 29, the ink cartridge 21 is slightly pushed again into the holder case 29 against the urging force of the coil spring 63. At this time, the lower end of the elastic piece 54 having the groove portion 52 constituting the air flow channel is bent in an S shape by the distance by which it is pushed forward with the movement of the air-introduction cylindrical portion 57 (see FIG. 10). The locking protrusion 43 of the locking rod 42*a* of the helical spring 42 is separated backward from the locking concave portion 28*b* of the locking portion 28 of the ink cartridge 21 and then comes in contact with the stopper wall 44 of the holder case 29. As a result, the locked state of the ink cartridge 21 by the locking protrusion 43 of the locking rod 42*a* of the helical spring 42 is unlocked.

When the pushing of the ink cartridge 21 is stopped after the locked state of the ink cartridge 21 is unlocked, the cartridge holder 20 allows the ink cartridge 21 to move toward the insertion hole 31 with the urging force of the coil spring 63. As a result, it is possible to detach the ink cartridge 21 from the cartridge holder 20. At this time, the locking rod 42*a* of the helical spring 42 in the cartridge holder 20 moves so that the locking protrusion 43 at the end thereof goes over the stepped portion 62*a* from the slope portion 62*b* in the engaging groove 62 in a state where it is in contact with the stopper wall 44 of the holder case 29, and then takes a posture directed to the insertion hole 31 of the cartridge holder 20 again. That is, the cartridge holder 20 enables the attachment and detachment of the ink cartridge 21 with the above-mentioned cycle.

According to this embodiment, the following advantages can be obtained.

(1) In the above-mentioned embodiment, the elastic piece 54 in which the groove portion 52 forming the air flow channel is formed is completely assembled into the cartridge holder 20 by fixing the elastic piece 54 to the holder case 29 along with the flow channel forming member 30 cut into a cantilever shape. When the ink cartridge 21 moves to apply the pressing force to the free end in the state where the air introduction hole 27 is in contact with the opening 57*a* of the air-introduction cylindrical portion 57 extending from the free end of the elastic piece 54 at the time of attaching or detaching the ink cartridge 21, the free end is elastically deformed about the fixed end. The restoring force of the elastically-deformed free end serves as an urging force bringing the opening 57*a* of the air-introduction cylindrical portion 57 into close contact with the air introduction hole 27 of the ink cartridge 21. Accordingly, it is not necessary to additionally assemble a sliding member or an urging member independent of the elastic piece 54 having the groove portion 52 formed therein. Therefore, it is possible to reduce the number of components, thereby improving the assembly efficiency and reducing the manufacturing cost.

(2) In the above-mentioned embodiment, the cartridge holder 20 supplies air into the ink cartridge 21 through the air flow channel, by bringing the opening 57*a* of the air-introduction cylindrical portion 57, the base end of which communicates with the communication hole 50 of the groove portion 52 forming the air flow channel, into close contact with the air introduction hole 27 of the ink cartridge 21. Accordingly, it is possible to draw out the pressurized ink from the ink cartridge 21 on the basis of the pressurizing force of the air.

(3) In the above-mentioned embodiment, the air flow channel is formed in the groove portion 52 constituting the air flow channel by bonding the film F to the flow channel forming member 30 to cover the front opening thereof. Accordingly, to form the air flow channel, it is not necessary to draw an air supply tube such as a silicon tube. Therefore, it is possible to suppress the leakage of ink from the silicon tube and the like and to omit the drawing space, thereby properly coping with the request for a decrease in size.

(4) In the above-mentioned embodiment, when the free end of the elastic piece 54 in which the groove portion 52 constituting the air flow channel is formed is elastically deformed with the pressing force from the ink cartridge 21, the air-introduction cylindrical portion 57 having the opening 57*a* at the end thereof is slidably guided in the axis direction by the guide hole 39 of the partition wall 35. Accordingly, it is possible to satisfactorily maintain the close contact state of the air introduction hole 27 of the ink cartridge 21 with the opening 57*a* of the air-introduction cylindrical portion 57.

(5) In the above-mentioned embodiment, the elastic piece 54 in which the groove portion 52 constituting the air flow channel is formed is formed by cutting the plate-like flow channel forming member 30 having elasticity in the cantilever shape elastically deformable. Accordingly, when the flow channel forming member 30 from which the elastic piece 54 having the groove portion 52 is formed is fixed to the cartridge holder 20, the cartridge holder 20 can be more easily assembled than when the fixed end of a member having the same cantilever shape as the elastic piece 54 is fixed directly to the cartridge holder 20.

(6) In the flow channel forming member 30 of the above-mentioned embodiment, the ink supply needle 55 that can be inserted into and pulled out of the ink supply hole 26 disposed in the ink cartridge 21 is formed to extend in the detachment direction of the ink cartridge 21 and the groove portion 51 constituting the ink flow channel along with the ink supply needle 55 and the groove portion 52 constituting the air flow channel are formed. Accordingly, by assembling the flow channel forming member 30, the flow channel of the ink contained in the ink cartridge 21 and the flow channel of the pressurized air flowing to and from the ink cartridge to supply the ink from the ink cartridge well can be rapidly and easily constructed.

(7) In the above-mentioned embodiment, the cartridge holder 20 is provided with the helical spring 42 having a locking protrusion 43 that can be locked to the locking portion 28 of the ink cartridge 21 located at the attachment position to regulate the movement in the detachment direction. Accordingly, at the attachment position, it is possible to satisfactorily maintain the state where the air introduction hole 27 of the ink cartridge 21 is in close contact with the opening 57*a* of the air-introduction cylindrical portion 57.

(8) In the above-mentioned embodiment, since the operating fluid introduced into the ink cartridge 21 is air, it is possible to improve the flow response property of the operating fluid between the ink cartridge 21 and the air-introduction cylindrical portion 57 by the difference in viscosity than when the operating fluid is liquid such as silicon oil. The flowing air is lighter than the liquid. Accordingly, when the operating fluid supply path is formed of a tube, the weight of the tube is reduced.

The above-mentioned embodiment may be modified as follows.

In the above-mentioned embodiment, the coil spring 60 urging the air-introduction cylindrical portion 57 to the insertion hole 31 of the holder case 29 may be omitted. That is, with only the restoring force of the elastic piece 54 having the groove portion 52, the opening 57*a* of the air-introduction cylindrical portion 57 may be brought into close contact with the air introduction hole 27 of the ink cartridge 21. In this case, it is possible to reduce the number of components, thereby improving the assembly efficiency of the cartridge holder 20 and reducing the manufacturing cost.

In the above-mentioned embodiment, the ink flow channel may be constructed to connect an ink supply tube independent of the flow channel forming member 30 constituting the air flow channel directly to the base end of the ink supply needle 55.

In the above-mentioned embodiment, the air flow channel is not formed by forming the groove portion 52 on one surface of the flow channel forming member 30 and then covering the opening with the film F, but by forming the hollow air flow channel in the flow channel forming member 30 to vertically penetrate the flow channel forming member.

In the above-mentioned embodiment, instead of allowing the air-introduction cylindrical portion 57 to protrude from the free end of the elastic piece 54 having the groove portion 52 constituting the air flow channel, a hollow air-introduction cylindrical portion may be formed to extend from the air introduction hole 27 of the ink cartridge 21 in the attachment direction of the ink cartridge 21 and the end thereof may be brought into close contact with the rear opening of the communication hole 50 at the free end of the elastic piece 54.

In the above-mentioned embodiment, the air introduction hole 27 of the ink cartridge 21 may be brought into close contact with the opening 57*a* of the air-introduction cylindrical portion 57 without the seal member 61 interposed therebetween.

In the above-mentioned embodiment, by connecting a negative pressure generator as an operating fluid source to an upstream end of the air supply tube 24, the negative pressure in the ink cartridge 21 may be adjusted to control the supply of the ink from the ink cartridge 21.

In the above-mentioned embodiment, the air is used as the operating fluid for pressurizing or depressurizing the inside of the ink cartridge 21. However, liquid such as silicon oil may be used as the operating fluid.

An example of the "fluid" in this specification can include liquid (including inorganic solvent, organic solvent, solution, liquid resin, liquid metal (metal melt), and the like) other than the ink, liquid-like material in which particles of functional materials are dispersed or mixed into liquid, and colloidal material such as gel. The liquid ejecting apparatus ejecting or spraying the "fluid" may be a liquid-like material ejecting apparatus ejecting liquid-like material in which material such as electrode material or coloring material (pixel material) used for manufacturing a liquid crystal display, an electroluminescence (EL) display, and a surface-emission display is dispersed or melted, a liquid ejecting apparatus ejecting bio organics used for manufacturing a bio chip, or a liquid ejecting apparatus used as a precise pipette to eject liquid as a sample. In addition, the liquid ejecting apparatus may be a liquid ejecting apparatus ejecting lubricant to a precise machine such as a clock or a camera by the use of a pin point, a liquid ejecting apparatus ejecting transparent resin liquid of UV-curable resin and the like onto a substrate to form a micro semi-circular lens (optical lens) used in an optical communication device, a liquid ejecting apparatus ejecting etchant such as acid or alkali to etch a substrate and the like, and colloidal material such as gel (for example, physical gel).

What is claimed is:

1. A fluid container holder having an attachment position to and from which a fluid container containing a fluid can be attached and detached with movement of the fluid container in a predetermined direction and comprising an operating fluid supply member bringing a holder flow hole into a close contact with a container flow hole of an operating fluid disposed in the fluid container so as to enable the operating fluid to flow when the fluid container is attached to the attachment position, wherein the operating fluid supply member has a cantilever shape of which a free end can be elastically deformed about a fixed end thereof, the holder flow hole is disposed at the free end, an operating fluid flow channel connecting the holder flow hole to an operating fluid source is disposed from the free end to the fixed end, and the free end is elastically deformed about the fixed end when the fluid container moves to apply a pressing force to the free end in a state where the container flow hole is brought into contact with the holder flow hole at the time of attachment to and detachment from the attachment position.

2. The fluid container holder according to claim 1, wherein the operating fluid supply member is configured to pressurize the inside of the fluid container by pressurizing and supplying the operating fluid into the fluid container in a state where the holder flow hole is brought into close contact with the container flow hole of the fluid container or to make the inside of the fluid container a negative pressure state by sucking the operating fluid from the inside the fluid container.

3. The fluid container holder according to claim 1, wherein a groove portion extending from the fixed end to the free end is formed on one surface of the operating fluid supply member, a film forming the operating fluid flow channel is bonded to the surface to cover the groove portion, and the holder flow hole is disposed on the other surface at the free end of the operating fluid supply member to communicate with the groove portion.

4. The fluid container holder according to claim 1, wherein a cylindrical portion extending in a detachment direction from the attachment position of the fluid container is provided to the free end of the operating fluid supply member, an opening of an end of the cylindrical portion constitutes the holder flow hole, and a guide portion slidably guiding the cylindrical portion in the axis direction thereof when the free end of the operating fluid supply member is elastically deformed is provided in the vicinity of the operating fluid supply member.

5. The fluid container holder according to claim 1, wherein the operating fluid supply member is formed by cutting a plate-like elastic flow channel forming member in the form of an elastically-deformable cantilever shape.

6. The fluid container holder according to claim 5, wherein the flow channel forming member is provided with a fluid supply member that can be inserted into or taken out of a fluid supply hole disposed independent of the container flow hole in the fluid container, so as to extend in the detachment direction from the attachment position of the fluid container and is provided with a fluid flow channel allowing the fluid, which is supplied from the fluid container through the fluid supply hole and the fluid supply member, to flow to the downstream where the fluid is consumed so as to avoid the cut portion of the operating fluid supply member.

7. The fluid container holder according to claim 1, further comprising a lock mechanism which can be locked to the fluid container so as to regulate the movement of the fluid container in the detachment direction in the state where the container flow hole is brought into close contact with the holder flow hole of the operating fluid supply member at the attachment position.

8. The fluid container holder according to claim 1, wherein the operating fluid is air.

9. A fluid ejecting apparatus comprising:

a fluid ejecting head ejecting a fluid; and the fluid container holder according to claim 1.

* * * * *